US005806195A

United States Patent [19]

Uttecht et al.

[11] Patent Number: 5,806,195

[45] **Date of Patent: *Sep. 15, 1998**

[54] RATE GYRO WELLS SURVEY SYSTEM INCLUDING NULLING SYSTEM

[76] Inventors: Gary Uttecht; James Brosnahan; Eric Wright; Greg Allen Neubauer, all of 1628 Westbelt North, Houston, Tex. 77043

[ * ] Notice: The term of this patent shall not extend beyond the expiration date of Pat. No. 5,657,547.

[21] Appl. No.: 877,159

[22] Filed: Jun. 17, 1997

Related U.S. Application Data

[63] Continuation of Ser. No. 358,867, Dec. 19, 1994, Pat. No. 5,657,547.

[51] Int. Cl.[6] ..... F21B 47/022; G01C 19/38; G01C 9/00

[52] U.S. Cl. ..... 33/304; 33/302; 33/313

[58] Field of Search ..... 33/304, 301, 302, 33/303, 312, 313, 114

[56] References Cited

U.S. PATENT DOCUMENTS

| | | | |
|---|---|---|---|
| 3,862,499 | 1/1975 | Isham et al. | 33/302 |
| 4,461,088 | 7/1984 | Van Steenwyk | 33/304 |
| 4,472,884 | 9/1984 | Engebretson | 33/312 |
| 4,524,324 | 6/1985 | Dickinson, III | 33/304 |
| 4,611,405 | 9/1986 | Van Steenwyk | 33/304 |
| 4,956,921 | 9/1990 | Coles | 33/304 |
| 5,172,480 | 12/1992 | Labuc et al. | 33/304 |
| 5,435,069 | 7/1995 | Nicholson | 33/304 |
| 5,657,547 | 8/1997 | Uttecht et al. | 33/304 |

*Primary Examiner*—Christopher W. Fulton
*Attorney, Agent, or Firm*—Gunn & Associates P.C.

[57] ABSTRACT

A method for well borehole survey is set out. A sonde supports X and Y accelerometers and X and & sensors on a rate gyro having a Z axis aligned with the sonde. On a slickline, or within a drill string, the sonde is used to measure four variables, these being $G_x$ and $G_y$, $A_x$ and $A_z$. This enables well azimuth and inclination to determined. Measuring depth enables a survey to be made.

60 Claims, 2 Drawing Sheets

FIG. 2
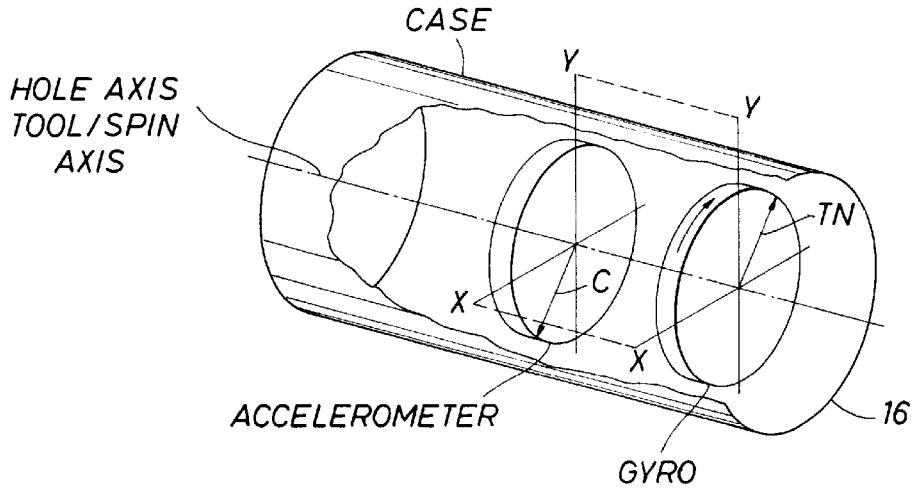
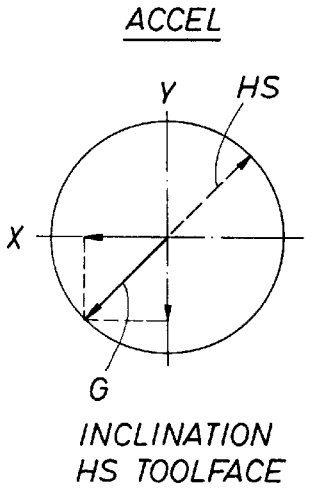
FIG. 3
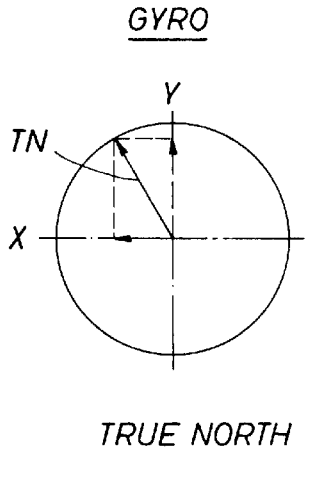
FIG. 4
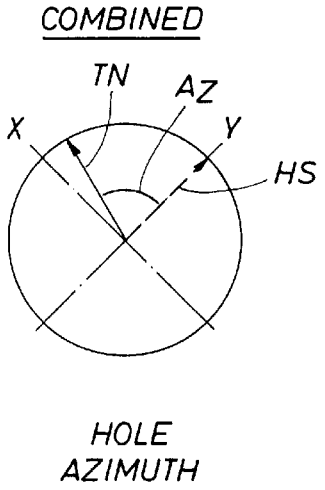
FIG. 5

RATE GYRO WELLS SURVEY SYSTEM INCLUDING NULLING SYSTEM

This application is a continuation of application Ser. No. 08/358,867 field Dec. 19, 1994, now U.S. Pat. No. 5,657, 547.

BACKGROUND OF THE DISCLOSURE

The present disclosure is directed to a rate gyro based survey device and a method of conducting a survey of a well borehole. In many instances, a well borehole is drilled which is substantially vertical. Rudimentary survey devices are used for such wells. By contrast, many wells are highly deviated. The well will define a pathway through space which proceeds from a centralized well head, typically clustered with a number of other wells, and extends in a serpentine pathway to a remote point of entry into a producing formation. This is especially the case with offshore platforms. Typically, an offshore platform will be located at a particular location. A first well is drilled to verify the quality of the seismic data. Once a producing formation is located, and is verified by the first well, a number of other wells are drilled from the same location. This is advantageous because it requires that the offshore drilling platform be anchored at a particular location. It is anchored at a given site and several wells are then drilled from that site. The wells drilled from a single site will enter the producing formation at a number of scattered locations. As an example, consider a producing formation which is 15,000 feet in length and width and which is located at a depth of 10,000 feet. From a single location approximately near the center, it is not uncommon to drill as many as 30 wells or more to the formation. Consider as an example an offshore location in about 200 feet of water where drilling is conducted into the single formation from a single platform location. After the first well has been drilled, a template is lowered to the mudline and rested on the bottom. The template typically supports several conductor pipes, typically arranged in a grid pattern such as 4×8. This provides a template with 32 holes in the template. Conductor pipes are placed in the holes in the template. Below that, a deviated well is drilled for most of the wells. Some of the wells are deviated so that they are drilled at an angle of perhaps only 30° with respect to the horizon as the wells are extended out laterally in a selected direction. The wells enter the formation at predetermined points. This means that each well has a first vertical portion, a bent portion below the conductor pipe, and then a long deviated portion followed by another portion which is often vertical. So to speak, the well is made of serial segments in the borehole.

A survey is necessary to determine the precise location of the well borehole. In most deviated wells, a free fall instrument typically is not used. Free fall survey instruments are used for fairly vertical wells. Where the vertical component is substantial and the lateral deviation is nil, survey instruments are readily available which can simply be dropped to obtain such data. Alternately, survey instruments are known which can be placed in the drill string at the time of retrieval of the drill string so that data is obtained as the drill string is pulled from the well borehole. This typically occurs when the drill bit is changed. The capture of accurate survey information is important, especially where the well is highly deviated. As an example, the well can be deviated where it extends at a 30° angle with respect to the horizon. It can have two or more large angular deflection areas. The well might terminate at a lateral location as much as 5,000 to 10,000 feet to the side of the drilling platform. Without regard to the lateral extent of the well borehole, and without regard to the azimuth or the depth of the well, it is important to obtain an accurate survey from such wells. In this instance, an accurate survey is required to enable drilling the well to the total depth desired and hitting the target entry into the producing formation. Typically, two or three surveys are required while drilling the well borehole. The surveys that are necessary enable correction to be undertaken so that the well can be further deviated to the intended location for the well.

In one aspect, the present disclosure sets forth a system which is able to be run on a slickline. The slickline is simply a support line to enable the sonde to be lowered to the bottom of the well borehole. The borehole path in space is located by the present system. In doing so, the sonde which encloses the equipment of the disclosure is lowered in either of two different fashions. In one instance, it can simply be lowered on the slickline and then left at the bottom of the drill string, and then is moved incrementally upwardly as the drill string is pulled. Pulling the drill string in necessary to change the drill bit which is periodically required. In that sequence, the device is lowered to the bottom of the drill string and is landed just above the drill bit. At that juncture of proceedings, the sonde cannot precede any further because it is captured within the drill string and is too large to pass through the openings in the drill bit. The drill bit is normally replaced by pulling the drill string. The drill string is pulled by removing the topmost joints of pipe. Typically, the derrick is sufficiently tall that three joints can be removed simultaneously. The three joints together comprise a stand which is placed in the derrick to the side of the rotary table. By this approach, the entire drill string is pulled incrementally moving the drill bit towards the surface for replacement. Each stand is approximately 90 feet in height. Therefore the drill bit is stationary for an interval sufficient to remove one stand, and these intervals are spaced at 90 feet in length. At each momentary stop in the process of removing the drill string, the drill bit is stopped and hence the sonde is stopped. This enables the device to obtain additional data. The data is measured at the stops while the survey is conducted.

In another procedure, the drill string is left in the well borehole. The sonde is lowered to the bottom of the well borehole on a slickline and is then pulled from the well borehole. In pulling, measurements are made by periodically stopping the sonde by stopping the slickline movement.

If the slickline gets in the way, it can be readily severed. A line cutting device is available which can be placed on the slickline and which is permitted to fall to the bottom of the slickline. The inertial upset which occurs when it strikes bottom is sufficient to cut the slickline and to enable retrieval of the slickline cutting apparatus and the slickline. This leaves the sonde in the drill pipe. It is left so that it can be retrieved along with the drill string. It is always found in the last joint of the drill stem (normally the bottom most drill collar) which is removed at the time that the drill string is pulled. As mentioned, pulling normally occurs during a trip to replace the drill bit.

The present disclosure sets forth an apparatus which particularly has an advantage in overcoming modest amounts of drift. It utilizes a rate gyro as well as two accelerometers. Both devices provide measurements in orthogonal directions. In the preferred construction of the device, measurements are made in the X and Y dimensions. By definition, the Z dimension is coincident with the center line axis of the cylindrical sonde. Therefore X and Y define a plane at right angles with respect to the Z axis. There is a scale problem which arises from the use of a rate gyro mixed with accelerometers. The sensitivity of a gyro is enhanced compared with accelerometers. Typically, the signals from the rate gyro are approximately two orders of magnitude more sensitive. This means that aging drift, temperature drift, drift as a result of vibration and the like are substantially amplified in the output signals from the rate gyro. One advantage of using a rate gyro is that the signal is so sensitive. It is however a detriment if the rate gyro signal is to be used in conjunction with signals from accelerometers. The present disclosure sets forth a mechanism in which the enhanced sensitivity of the rate gyro compared with the accelerometers is used to advantage. One aspect of this derives from a mechanism which rotates the rate gyro housing 180°. The housing is coincident with the axis through the tool so that the rate gyro is rotated about the Z axis. If the rotation is precisely 180°, then the X and Y outputs from the rate gyro will be reversed. They will be reversed precisely thereby yielding the same output data with a reversal in sign. If a value is obtained denoted as +X, and a second value is obtained which is denoted as −X, then the sum of these two values should be zero in a perfect situation, or should there be a minor amount of error in the system such as drift or other error, the difference in the two is dependent on the error, and the more precisely is two times error. This will be represented below as 2Δ Knowing this, the error Δ can be isolated, and can then be eliminated from the data. Not only is this is true for the X dimension, it is also true for the Y dimension. Therefore both errors can be overcome. This enable the presentation then of a rate gyro signal which is substantially free of that type of error.

The present disclosure takes advantage of onboard computing through a CPU which has provided with suitable power from operation by a power supply and which works with data which is input to the CPU. The data is written temporarily in memory. After a set of data is obtained, the set is then processed to reduce the amount of memory storage required. Speaking more specifically, in one aspect of the present disclosure, a set or ensemble of data is obtained. The number of measurements is represented by N where N is a whole number positive integer. The integer is typically a multiple of two so that data processing is simplified. In one aspect of the present disclosure, N is typically 64, 128, 256, . . . . As will be seen, these represent values of N where N is a multiple of two.

In summary, the present disclosure sets fourth a method and apparatus for obtaining survey data from a slickline supported tool which is maintained on the slickline or which is left in the drill string just above the drill bit. In both aspects, data is taken as the sonde which encloses the apparatus is pulled toward the surface either on the slickline or on removal of the drill string from the well borehole. In both instances, data is captured by making multiple measurements at a given depth in the well borehole whereby N data are collected and processed. The data are obtained from X and Y accelerometers and X and Y output sensors on a rate gyro. This provides four sets of data. The data are stored temporarily in memory until the N data are accumulated from the four sensors. The four sensors provide this data at one position, and then the rate gyro housing is rotated so that the data are provided from an alternate position. The alternate position is intended to be precisely equal and opposite. The second set of N data therefore provides data which ideally should subtract from the first set of data for the rate gyro. This enables nulling to substantially reduce the highly amplified effects of drift and the error in the rate gyro data. The N data are then averaged to provide four values two of which derived from the rate gyro and two of which are obtained from the accelerometers. The several data for each of the four sensors are statistically analyzed to provide the standard deviation. This is an indication of data quality.

DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may add to other equally effective embodiments.

FIG. 2 is a perspective view of the sonde showing the X and Y orientation of the gyro and accelerometer sensors with respect to the Z axis which is coincident with the sonde housing;

FIG. 3 is an X and Y plot of the output signals of the accelerometers with respect to an X and Y coordinate system showing how he gravity vector G impacts the sensors and thereby provides useful data;

FIG. 4 is a view similar to FIG. 3 for the gyro showing how a vector is located with indicates true north; and FIG. 5 is a combined coordinate system derived from FIGS. 3 and 4 jointly showing how true north cooperates with other measurements to thereby provide a indication of whole azimuth.

DETAILED DESCRIPTION OF THE PREFERRED EMBODIMENT

Figure 1:
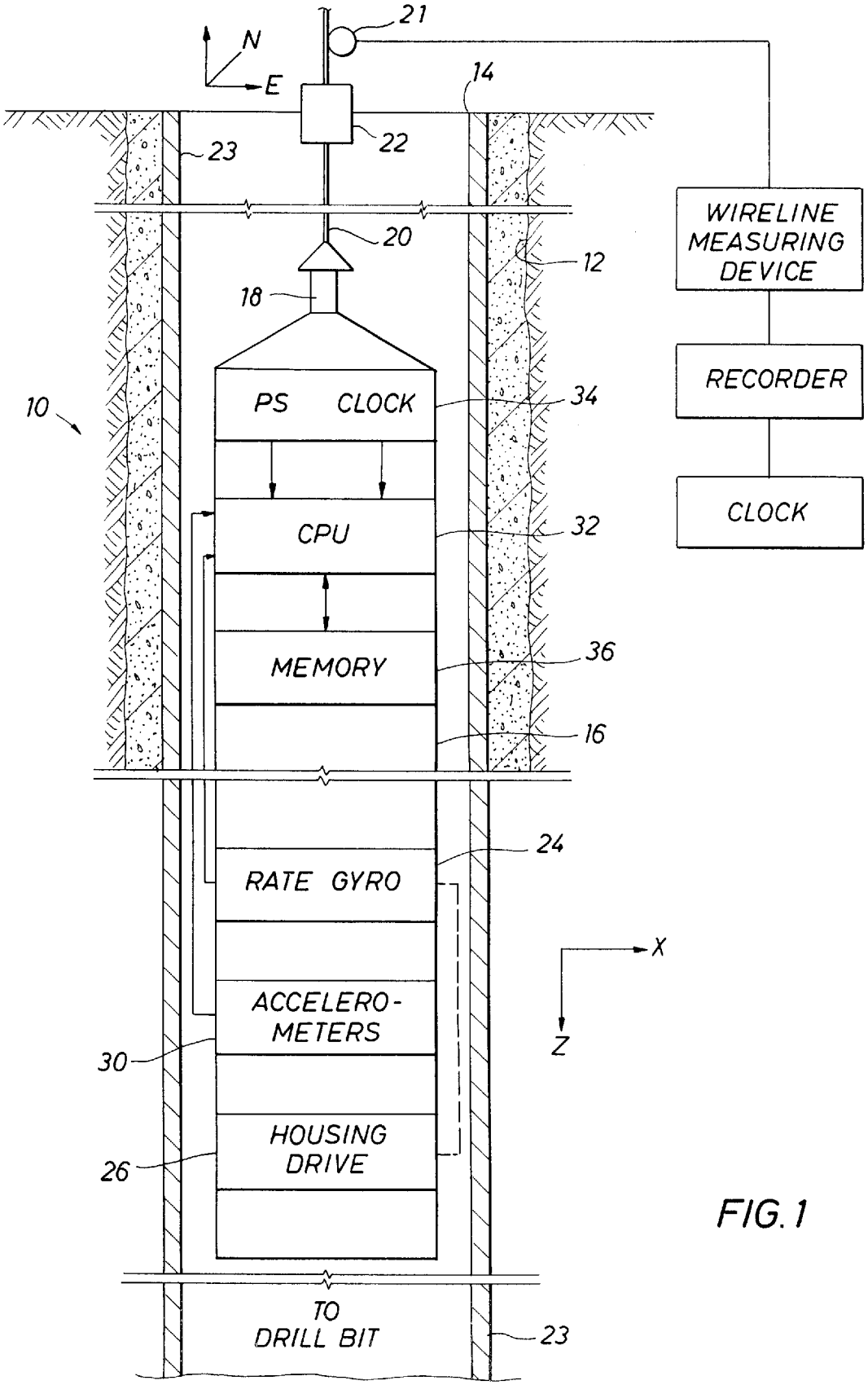
FIG. 1 is a schematic diagram of the sonde of the present disclosure supported in a well borehole on a slickline and further shows a relative reference system for the sonde and a surface located reference system.

Attention is first directed to FIG. 1 of the drawings where the numeral 10 identifies the apparatus of the present disclosure. It is shown in a well borehole 12 which extends into the earth from a well head location 14. At the well head, there is a reference system which is illustrated. At the surface, the reference system utilizes directional measurements namely those on a compass rose. Ideally it is oriented to true north. In other words, to the extent that magnetic north is different from true north at different locations on the earth, it is preferable to use true north. Often, magnetic north can be measured and a simple adjustment incorporated because the deviation between true north and magnetic north is well known. The compass defines the orthogonal measurements as mentioned, and that therefore defines the vertical dimension also. The three references of course describe an orthogonal coordinate system.

The tool 10 is constructed in a cylindrical shape and is enclosed within a shell or housing known as a sonde 16. The sonde is for the protection of the apparatus located on the interior. The sonde at the upper end incorporates a fishing neck 18 for easy retrieval. It is incorporated so that a grappling type device can engage the fishing neck for retrieval. It is lowered into the well borehole on a slickline 20. The slickline does not include an electrical conductor. In that instance, it would normally be termed as a wire line because it includes one or more electrical conductors. Rather, it is a small diameter wire of sufficient strength to support the survey tool 10. The slickline extends to the surface. From the surface, the slickline is lowered into the well bore hole. Typically, this must be done through a blow out preventor to prevent pressure from blowing up through the well and out through the wellhead. The slickline, once the tool has been extended to the bottom of the well borehole, can be cut by placing a cutter device 22 on the slickline which travels to the bottom. When it is stopped, the inertial upset associated with that sudden stop causes a cutter mechanism inside the cutter 22 to sever the slickline. The slickline can then be retrieved with the apparatus 22 clamped on the lower end of the slickline. In one other aspect, FIG. 1 has been simplified simply by omitting the drill string from the drawing representation. As a practical matter, the tool of the present disclosure is normally lowered on the interior of a drill string 23. It is lowered to the bottom drill string closed at the lower end by a drill bit. As will be understood, it is necessary to obtain a survey from a partly drilled well borehole. In the drilling of a well borehole, the drill 23 supports the drill bit at the very bottom end of the drill string. The lowermost tubular member is typically a drill collar. At least one and sometimes as many as ten drill collars are incorporated.

The sonde 10 can be retrieved on the slickline 20 and measurements correlated to depth recorded by a measuring device having a measuring wheel contacted against the line 20. The measurement data is stored by a recorder as a function of time.

The drill string is normally extended in the well bore hole until the point in time that the drill bit has worn. The rate of penetration is normally measured and this is some indication that the drill string needs to be pulled to replace a worn drill bit. The life of a drill bit is typically reasonably well known. The life of the drill bit of course is somewhat dependent on the formation materials being drilled at the moment; in this aspect of the present disclosure, the drill bit is pulled with the drill string and is replaced with a new drill bit of a selected type for continued drilling in a particular type formation.

The present disclosure particularly features the sonde 16 which is a sealed housing for the apparatus. It is able to operate in a steel drill pipe because it is not dependent on magnetically induced measurements. In other words, it is not necessarily responsive to the magnetic field of the earth. In that instance, it would require that the bottom most drill collar be formed of some nonmagnetic material. Such drill collars are quite expensive and can be avoided through the use of the present apparatus.

As further shown in FIG. 1 of the drawings, there is a tool related reference system. The Z dimension is coincident with the central axis of the elongate cylindrical tool. X and Y are dimensions at right angles as before. The rate gyro which is supported in this apparatus is axially coincident with the central or elongate dimension of the sonde 16. The present apparatus utilizes a rate gyro 24. The rate gyro is enclosed in a suitable housing. The housing, sensors, and rotating member are apparatus which can be discussed in schematic form because it is a device well known in a number of application including oil well survey equipment. In other words, the rate gyro need only be shown in schematic form. It incorporates a housing which encloses the moving components. The housing itself is mounted for rotation about the Z axis, and a housing drive 26 is included. This drive rotates the housing precisely through 180° rotation. This rotation is about the Z axis or the axis of the sonde 16. The Z axis of the sonde is defined by the coordinate system previously mentioned, and hence rotation of the rate gyro about that axis provides measurements which will be discussed below taking into account the X and Y dimensions in the tool related coordinate system.

In FIG. 1 of the drawings, the accelerometers 30 are also indicated in schematic form. As further illustrated, the housing drive 26 is connected with rate gyro 24 to provide the above described rotation. The data from the four sensors, two accelerometers 30 and two sensors associated with the rate gyro 24, are all input to the CPU 32. The CPU is provided with a suitable power supply and a clock 34 for operation. A program in accordance with the teachings of the present disclosure is stored in memory 36, and the data that is created during test procedures is likewise written in memory. When retrieved to the surface, the memory can be interrogated, and the data removed from the sonde 10 for subsequent and separate processing.

To better understand the present apparatus, attention is momentarily directed to FIG. 2 of the drawings. As shown there, the sonde including the shell 16 is illustrated. In it, there are the two sets of sensors shown in symbolic form with particular emphasis on the X and Y coordinates for the two sets of sensors. As marked in FIG. 2, the X and Y dimensions are coincident. They differ in that the two sensor devices are offset along the length of the sonde. This offset does not impact the output data.

Going further with the structure shown in FIG. 2 of the drawings, there is imposed on the drawing the centerline axis through the shell 16 which forms the protective jacket of the sonde. Moreover the rate gyro which rotates in a plane transverse to the axis is likewise illustrated and a significant aspect of it is indicated, namely, the ability to locate true north. Likewise, the two accelerometers are able to locate the gravity vector which is indicated in FIG. 2 of the drawings. Going more specifically however to the symbolic representations which are sent forth in FIGS. 3, 4, and 5 considered jointly, it will be seen that the accelerometers provide two outputs. They will be represented symbolically as $A_x$ and $A_y$. These are the two signals which are provided by the two accelerometers. In space, they define two resolved components of the gravity vector which is represented by the symbol G. As further shown in the drawings, the gravity vector which points toward the center of the earth defines an equal and opposite vector. That vector is represented by the symbol HS which refers to the high side of the tool face. The significance of that is understood with the explanation below.

FIG. 4 of the drawings shows the two output signals from the gyro which, as resolved components, defines a vector which points in the direction of true north represented by TN in FIG. 4. These representations shown in FIGS. 3 and 4 are combined in FIG. 5 of the drawings. True north is useful for orienting the measuring instrument 10 in space. Once that is known in conjunction with vector HS, the hole azimuth can be determined. That is represented by the vector $A_z$. The representations in FIGS. 3, 4, and 5 are significant in describing operation of the device of this disclosure.

One important feature of the present apparatus is brought out by the method of operation. Consider a first set of readings which is obtained by use of the survey tool which is shown in FIG. 1 of the drawings. Assume for purposes of discussion that the survey tool is lowered on a slickline to the bottom of a drill string and is left resting on the bottom the drill string just above the drill bit. At that location, the sonde is then located so that data can be obtained from a first location in the well borehole. Through the use of the present apparatus, measurements are obtained which are represented as $A_x$, $A_y$, $G_x$, and $G_y$. Preferably, many measurements are made, the number being represented by N, and they are recorded in memory. Assume for purposes of discussion that N data points is 128 or 256. Through the use of conventional statistical programs readily available, all of the data at a given tool depth in the well borehole is collectively analyzed and the standard deviation of the four variables is then obtained. The standard deviation is recorded along with the average value. While N data are obtained for all the four variables at a given depth, the data are reduced to single values so that each of the four variables are individually and uniquely represented.

As one example, assume that the sonde 10 is lowered to precisely 10,000 feet in the well borehole and a set of data is obtained. Assume also that N is 256. 256 entries are recorded in memory for each of the four variables. Then, the four variables are averaged and the standard deviation for each of the four is also obtained.

At this juncture, the data derived from the rate gyro includes averaged values of $G_x$ and $G_y$. The next step is to rotate the gyro housing. Measurements again are made. These measurements are made after rotation and ideally are measurements which are equal and opposite the first measurements. The second set of N data is likewise averaged, and the standard deviation is again determined. The first average value for $G_x$ is then compared with the second average value of $-G_x$. When the two are added, the two values should subtract to zero. In other words, the second set of data is subtracted from the first set of data from the rate gyro measurements.

One aspect of the present disclosure is that the N data are first captured with the housing in one position and then the housing is rotated and data again is obtained. Data from the second position is ideally equal and opposite for the X and Y sensors in the rate gyro. While the first data will represent $G_x$, the next data likewise will be $G_x$. The second set of data is averaged and again the standard deviation is obtained. The second set of data is subtracted from the first set for the rate gyro measurements. In other words, a difference signal is obtained which is $G_x$ minus the second measurement of $-G_x$. Any small error which is obtained upon subtraction of the two values is primarily a function of error in the equipment. These error differences can be useful in evaluating the quality of the data.

The foregoing routine should be considered with respect to the position of the rate gyro system 10 in the well borehole. Data is preferably collected from the bottom to the top. To do this, at the time that a drill string is to be pulled on a trip to replace the drill bit, the measuring instrument 10 is pumped down the drill string supported on the slickline. When it lands at the bottom, the line is severed and retrieved so that it will not connect the several stands of pipe together. A first data is collected. This is collected while the drill bit is at bottom. This is accomplished when the drill string is not rotating. The averages are obtained for values of $G_x$, $G_y$, $A_x$, and $A_y$. In addition, the standard deviation for all four measurements is likewise obtained, thereby representing eight data, four being the average measurements and four being the standard deviation of those measurements. The housing is then rotated and the second set of measurements are obtained. These are the measurements of $G_x$ and $G_y$. They are recorded for later subtraction, or they can be automatically subtracted by the CPU.

The collection of data requires a finite interval. The N(=256) measurements process is done in a few seconds. Earth movement continues while collecting the data long the well. The N measurements are taken at M depths.

The term M represents the number of measurements made at a specified depth along the well borehole. An example will be given below which involves 100 measurements or M=100.

The averaged measurements and deviation data are stored and are subsequently retrieved when the tool 10 is brought to the surface. Assume for purposes of description that the well is 9,000 feet in depth. The drill stem is made of stands of pipe so that data from 100 depths are obtained. The first set of N data are collected while the drill bit is on bottom and the second set of N data is collected after rotation of the gyro housing before the drill bit is raised by removal of the first stand of pipe. This can be continued indefinitely until the entire drill stem has been removed to enable bit replacement. This will create M data in the 9000 feet of borehole.

At each stopping place for the drill string where the drill string is suspended while another stand of pipe is removed from the drill string, the housing is rotated so that two sets of gyro data are obtained. This is repeated until the drill bit is brought to the surface. The measuring instrument 10 of the present disclosure is carried up the borehole in the bottom most drill collar resting on top of the drill bit. The sonde is then removed and connected to a suitable output cable to enable transfer of the measured data out of the sonde into another memory device. This enables the data to be further analyzed and used in plotting a survey of the well borehole.

As noted from the foregoing, one important advantage of the system is that N data are obtained with the housing positioned in one direction or orientation and then another set of N data are obtained with the housing rotated by 180°. This is done repetitively as the drill string is pulled.

The present system is not susceptible to distortions which arise from the incorporation of ferrous materials in the drill string. The present apparatus operates in ferrous pipe. This avoids the costly isolation step of installing an exotic alloy drill collar in the drill string. Such drill collar are relatively expensive. For example, a drill collar made of Inconel (an alloy trademark) is very expensive compared to a drill collar made of steel. The presently disclosed system avoids that costly requirement.

Consider now the steps necessary to construct a survey. For each depth, measurements from the four sensors (highly refined averages) were made at a particular elevation in the well borehole with a specified orientation of the tool in the well borehole. A careful and detailed survey can be obtained by this procedure using M sets of data where M is an integer representing the number of measurement sets of N data recorded at M locations in the well. The typical operation records data where M equals one with the drill bit on bottom. The next (M=2) is measured when the first stand of pipe is pulled.

In the foregoing, each of the M measurements stations are located spaced from adjacent stations by one stand of pipe or approximately 90 feet. This dimension is well known. The data collected thus has M sets of data where M represents the number of stops made in retrieving the drill string. This provides M finite locations along the pathway. The pathway can then represented in a three dimension plot of the well as a survey. The typical representation utilizes three variables which are depth in the well borehole. In addition, the inclination and azimuth of the well borehole can be determined. The three variables provide a useful representation of data which has the form of a survey as mentioned.

In another way of operation, the tool can be lowered in the well borehole to a desired depth, and the first of the M measurements is made with the drill bit at the bottom of the borehole and the sonde rested above the drill bit in the drill string. Then, the slickline is retrieved from the borehole by a specified measurement. If the well is 10,000 feet in depth, it is not uncommon to move the sonde 100 feet. In this instance, the M sets of measurements would be 100 or M=100. This enables operator control of the spacing of the data points along the survey. In a highly deviated well, the survey points may be quite close together. In a well which only deviates slightly, the survey points can be farther apart which permits a smaller value of M. In this particular instance, M and N can be selected by the operator. Loosely, they represent scale or spacing along the survey. As before, the survey typically is reported in the form of azimuth, inclination, and location along the well borehole. As noted with regard to FIGS. 3, 4 and 5, azimuth and inclination can be obtained from the data. Data quality is likewise obtained by noting the standard deviation. While the foregoing is directed to the preferred embodiment, the scope can be determined from the claims which follow.

We claim:

1. A method of performing a survey of a well borehole comprising the steps of:

(a) positioning within a well borehole an elongate sonde having a rate gyro therein rotating about an axis and forming an output indicative of north, wherein said rate gyro is supported by a housing rotatable between first and second positions separated by 180° of housing rotation, and (i) a first output indicative of north comprises N measurements is determined at said first sonde position, (ii) said housing is then rotated by 180° and a second output indicative of north comprising another N measurements is determined at said second sonde position, and (iii) N is an integer;

(b) combining said first and second outputs indicative of north to yield a measure of north in which systematic instrument error is reduced;

(c) positioning the sonde at spaced locations along a well borehole; and (d) repeating step a) at each said spaced location.

2. The method of claim 1, wherein N is greater than 1 and said first output indicative of north is obtained from an average of said N measurements and said second output indicative of north is obtained from an average of said N measurements with said housing rotated 180°.

3. The method of claim 2 wherein rate gyro housing rotation occurs after N measurements are made, thereby enabling said N measurements to be made in a selected time interval and a second set of measurements to be made in a second selected time interval.

4. The method of claim 2 wherein each said spaced location is at evenly spaced locations along said well borehole so that the borehole survey has a desired set of data points.

5. The method of claim 1, wherein;

(a) said first output indicative of north is defined in a first X-Y quadrant which is orthogonal to the major axis of said elongated sonde;

(b) said second output indicative of north is defined in a second X-Y quadrant; and (c) said first and second X-Y quadrants lie in a common plane and are azimuthally spaced at 180°.

6. The method of claim 1 wherein said sonde is lowered to the bottom of a drill string in the well borehole on a slickline and the slickline is retrieved leaving the sonde in said well borehole.

7. The method of claim 6 including the additional step of measuring the direction of said sonde along said well borehole at each said spaced location, and determining therefrom gravity direction at each said spaced location while tripping said drill string out of the borehole.

8. The method of claim 7 wherein said measurements of north and said gravity direction measurements are made spaced along said well borehole by the length of a stand of pipe in the drill string.

9. The method of claim 1 wherein said sonde is lowered to the bottom of said well borehole to enable a survey to be conducted, retrieving the sonde along the borehole, and making said measurements along the borehole said spaced locations.

10. The method of claim 9 wherein said sonde is stopped at said spaced locations along said well borehole and said measurements are made and stored in the sonde until retrieval to the surface.

11. A method of obtaining a survey in a well borehole subject to deviation from the vertical which comprises the steps of:

(a) positioning in a well borehole a rate gyro having an axis of rotation coincident with the major axis of a sonde which supports said rate gyro;

(b) moving said sonde along the well borehole and making two orthogonal signal measurements at spaced locations;

(c) combining said two orthogonal signals measurements to obtain a reference north measurement;

(d) reducing systematic instrument error ill said orthogonal signal measurements by making measurements differing by 180°;

(e) measuring the direction of gravity along the sonde during movement in the well borehole by making an additional two orthogonal signal measurement; and (f) determining from said additional two orthogonal measurements at least two dimensions of the position of the sonde in the well borehole.

12. The method of claim 11 including the step of determining sonde depth within said well borehole.

13. The method of claim 12 including the step of determining well borehole azimuth for said survey.

14. The method of claim 13 including the step of determining well borehole inclination for said survey.

15. The method of claim 14 including the step of making said signal measurements recorded in memory within said sonde and retrieving the sonde to obtain data recorded in memory.

16. A method of performing a survey of a well borehole comprising the steps of:

(a) positioning within a well borehole an elongate sonde having a rate gyro therein rotating about an axis and forming an output indicative of north, wherein said rate gyro is supported by a housing rotatable between first and second positions separated by 180° of housing rotation, and (b) making a first gyro measurement indicative of north;

(c) moving said gyro and making second, third and fourth measurements indicative of north and wherein (i) said first and said third measurements arc at 180°;

(ii) said second and said fourth measurements are at 180°; and (iii) said measurements are made after 90° rotation;

(d) summing said measurements indicative of north to yield a measure of north;

(e) reducing instrument error in said summation of north by combining said measurements;

(f) moving said sonde between spaced locations along a well borehole; and (g) repeating steps (b)–(e) at each said spaced location.

17. The method of claim 16 wherein said first, second, third and fourth measurements are each defined by an average of N measurements, where N is an integer greater than 1.

18. The method of claim 17 wherein rate gyro housing rotation occurs after N measurements are made, thereby enabling said N measurements to be made in a selected time interval.

19. The method of claim 16 wherein each said spaced location is at evenly spaced locations along said well borehole so that the borehole survey has a desired set of data points.

20. The method of claim 16 wherein said sonde is lowered to the bottom of a drill string in the well borehole on a slickline and the slickline is retrieved leaving the sonde in said well borehole.

21. The method of claim 20 including the additional step of measuring the direction of said sonde alone said well borehole at each said spaced location, and determining therefrom gravity direction at each said spaced location while tripping said drill string out of the borehole.

22. The method of claim 21 wherein said measurements of north and said gravity direction measurements are made spaced along said well borehole by the length of a stand of pipe in the drill string.

23. The method of claim 16 wherein said sonde is lowered to the bottom of said well borehole to enable a survey to be conducted, retrieving the sonde along the borehole, and making said measurements along the borehole said spaced locations.

24. The method of claim 23 wherein said sonde is stopped at said spaced locations along said well borehole and said measurements are made and stored in the sonde until retrieval to the surface.

25. A method for measuring the position of a survey sonde in a well borehole, comprising the steps of:

(a) positioning a rate gyro in a well survey sonde;

(b) moving the sonde to a survey position in the well borehole;

(c) making a first and a second gyro reading at that survey position, wherein said first and second gyro readings provide information useful in determining north;

(d) positioning a pair of accelerometers at right angles in said sonde wherein one accelerometer is located in a plane at right angles to the major axis of said sonde;

(e) moving the sonde to a second survey position along the well borehole;

(f) making accelerometer measurements as the sonde moves along the well borehole; and (g) determining from said gyro measurements and said accelerometer measurements the path of the well borehole in the earth.

26. The method of claim 25 wherein said sonde is lowered to the bottom of a drill string in the well borehole on a slickline and the slickline is retrieved leaving the sonde in said well borehole.

27. The method of claim 26 wherein said sonde is moved along the well borehole while tripping said drill string out of the borehole.

28. The method of claim 25 wherein said gyro measurements and said accelerometer measurements are made at spaced locations along said well borehole by the length of a stand of pipe in a drill string.

29. The method of claim 25 wherein said sonde is lowered to the bottom of said well borehole, retrieving the sonde along the borehole, and making said gyro and accelerometer measurements along the borehole said spaced locations.

30. The method of claim 29 wherein said sonde is stopped at said spaced locations along said well borehole and said gyro and accelerometer measurements are made and stored in the sonde until retrieval to the surface.

31. The method of claim 30 wherein said direction measurements are made at a plurality of spaced locations within said well borehole.

32. A method of performing a survey of a well borehole comprising the steps of:

(a) positioning within a well borehole an elongate sonde having a rate gyro therein rotating about an axis and forming an output indicative of north, wherein said rate gyro is supported by a housing rotatable between first and second positions separated by 180° of housing rotation, and wherein power to operate components within said sonde is supplied by a power supply within said sonde, and (i) a first output indicative of north comprises N measurements is determined with said gyro in said first position, (ii) said housing is then rotated by 180° and a second output indicative of north comprising another N measurements is determined with said gyro in said second position, and (iii) N is an integer; and (b) combining said first and second outputs indicative of north to yield a measure of north which contains reduced systematic instrument error.

33. The method of claim 32 wherein N is greater than 1 and said first output indicative of north is obtained from an average of said N measurements and said second output indicative of north is obtained from an average of said N measurements with said housing rotated 180°.

34. The method of claim 33 wherein rate gyro housing, rotation occurs after N measurements are made, thereby enabling, said N measurements to be made in a selected time interval and a second set of measurements to be made in a second selected time interval.

35. The method of claim 33 including the additional step of;

(a) providing two accelerometers within said sonde;

(b) measuring the inclination of said sonde within said well borehole using, the responses of said accelerometers; and (c) determining therefrom gravity direction.

36. A method claim 35 including the additional steps of:

(a) making a third and a forth measurement, both of which are responsive to north and which are 180° apart and wherein (i) said first and said third measurements are at 180°, and (ii) said second and said fourth measurements are at 180°;

(b) summing, said measurements responsive to north to yield a measure of north; and (c) reducing instrument error in said measurement of north by combining said first and third measurements responsive to north.

37. The method of claim 36 wherein said first and third measurements are made with said gyro, and said second and fourth measurements are made with one of said two accelerometers.

38. The method of claim 32 wherein;

(a) said first output indicative of north is defined in a first X-Y quadrant which is orthogonal to the major axis of said elongated sonde;

(b) said second output indicative of north is defined in a second X-Y quadrant; and (c) said first and second X-Y quadrants lie in a common plane and are azimuthally spaced at 180°.

39. A method of obtaining a survey in a well borehole, comprising the steps of:

(a) positioning in a well borehole a rate gyro;

(b) obtaining direction measurements X, Y, −X and −Y from the response of said rate gyro, wherein X and −X differ by 180° and Y and −Y differ by 180°;

(c) obtaining a reference direction measurement from said direction measurements; and (d) combining pairs of said direction measurements to reduce systematic instrument error in said reference direction measurement.

40. The method of claim 39 wherein;

(a) said rate gyro comprises at least one axis: and (b) said rate gyro is positioned such that X+90°=Y.

41. The method of claim 40 wherein each of said direction measurements are repeated N times at at least one spaced location within said well borehole.

42. The method of claim 41 where N is an integer greater than one.

43. The method of claim 39 wherein said reference measurement is true north.

44. The method of claim 39 wherein said reference measurement is a high side of a sonde containing said rate gyro.

45. A method for obtaining the orientation of a sonde within a well borehole, comprises the steps of:

(a) positioning a rate gyro having at least one axis within said sonde;

(b) with said gyro, making at least two orthogonal signal measurements at at least one location within said well borehole;

(c) obtaining a measure of true north from said two orthogonal signal measurements;

(d) measuring the direction of gravity at said at least one location within said well borehole; and (e) determining from said at least two orthogonal signal measurements and said measure of gravity the azimuthal orientation of said sonde within said well borehole.

46. The method of claim 45 wherein said orientation of said sonde comprises the position of the high side of the sonde with respect to true north.

47. The method of claim 45 further comprising the steps of:

(a) moving said sonde along the well borehole;

(b) obtaining said measures of true north and of gravity at M spaced locations within said well borehole, where M is an integer greater than 1; and (c) determining said azimuthal orientation of said sonde within said borehole at each said spaced location.

48. The method of claim 45 wherein said sonde is affixed to a second borehole instrument, and the orientation of said second borehole instrument within said borehole is obtained from said orientation of said sonde within said borehole.

49. The method of claim 45 wherein an additional two signal measurements are made and combined with said two orthogonal signal measurements to reduce systematic instrument error in said measure of true north.

50. The apparatus of claim 49 wherein said means for conveying said sonde comprises affixing said sonde to a borehole instrument which is conveyed by means of a wireline.

51. The apparatus of claim 50 wherein said sequence of data defines the azimuthal orientation of said borehole instrument within said well borehole.

52. The apparatus of claim 51 wherein said azimuthal orientation is defined with respect to said measure of true north.

53. An apparatus for measuring a sequence of data from within a well borehole, comprising;

(a) a sonde which is conveyed within said borehole, wherein said sonde comprises
  (i) a rate gyro comprising at least one axis,
  (ii) a power supply to operate said rate gyro,
  (iii) a memory for recording response of said rate gyro, and
  (iv) means for measuring the direction of gravity acting upon said sonde;

(b) a CPU for
  (i) combining a first and a second measurement from said rate gyro to obtain a measure of true north,
  (ii) combining a third and a fourth measurement from said rate gyro with said first and second measurements to reduce systematic instrument error in said measure of true north; and
  (iii) combining said measure of gravity direction and said measure of true north to obtain said measured sequence of data; and (c) means for conveying said sonde within said well borehole.

54. The apparatus of claim 53 wherein said means for conveying said sonde comprises a slick line.

55. The apparatus of claim 53 wherein said means for conveying said sonde comprises a drill string.

56. The apparatus of claim 53 wherein said means for conveying said sonde comprises the force of gravity.

57. The apparatus of claim 53 further comprising means for measuring the depth of said sonde within said well borehole.

58. The apparatus of claim 53 wherein said sequence of data defines a three dimensional path of said well borehole within the earth.

59. The apparatus of claim 53 wherein said sequence of data defines the azimuthal orientation of said sonde within said well borehole.

60. The apparatus of claim 59 wherein said azimuthal orientation is defined with respect to said measure of true north.

* * * * *